US007986208B2

(12) United States Patent
Yan et al.

(10) Patent No.: US 7,986,208 B2
(45) Date of Patent: Jul. 26, 2011

(54) SURFACE MOUNT MAGNETIC COMPONENT ASSEMBLY

(75) Inventors: Yipeng Yan, Shanghai (CN); Robert James Bogert, Lake Worth, FL (US)

(73) Assignee: Cooper Technologies Company, Houston, TX (US)

( * ) Notice: Subject to any disclaimer, the term of this patent is extended or adjusted under 35 U.S.C. 154(b) by 111 days.

(21) Appl. No.: 12/429,856

(22) Filed: Apr. 24, 2009

(65) Prior Publication Data

US 2010/0007451 A1 Jan. 14, 2010

Related U.S. Application Data

(60) Provisional application No. 61/080,115, filed on Jul. 11, 2008.

(51) Int. Cl.
*H01F 27/29* (2006.01)

(52) U.S. Cl. ..... 336/192

(58) Field of Classification Search ..... 336/65, 336/83, 192, 200, 232
See application file for complete search history.

(56) References Cited

U.S. PATENT DOCUMENTS

| | | | | |
|---|---|---|---|---|
| 5,912,609 | A * | 6/1999 | Usui et al. | 336/83 |
| 6,392,525 | B1 | 5/2002 | Kato et al. | |
| 7,397,338 | B2 * | 7/2008 | Sano et al. | 336/212 |
| 2003/0218527 | A1 * | 11/2003 | Okamoto | 336/208 |
| 2006/0022788 | A1 * | 2/2006 | Sasamori et al. | 336/208 |
| 2008/0310051 | A1 | 12/2008 | Yan et al. | |
| 2009/0058588 | A1 | 3/2009 | Suzuki et al. | |
| 2010/0007451 | A1 | 1/2010 | Yan et al. | |
| 2010/0007453 | A1 | 1/2010 | Yan et al. | |
| 2010/0013587 | A1 * | 1/2010 | Yan et al. | 336/192 |

FOREIGN PATENT DOCUMENTS

| | | | |
|---|---|---|---|
| EP | 1526556 | A1 | 4/2005 |
| JP | 05291046 | | 11/1993 |
| JP | 03241711 | | 2/1999 |
| WO | 0191141 | A1 | 11/2001 |
| WO | 2008008538 | A2 | 1/2008 |

OTHER PUBLICATIONS

International Search Report and Written Opinion of PCT/US2010/032798; Aug. 20, 2010; 15 pages.
International Search Report and Written Opinion of PCT/US2010/031886; Aug. 18, 2010; 14 pages.
International Search Report and Written Opinion of PCT/US2010/032517; Aug. 12, 2010; 16 pages.

* cited by examiner

*Primary Examiner* — Tuyen Nguyen
(74) *Attorney, Agent, or Firm* — Armstrong Teasdale LLP

(57) ABSTRACT

A surface mount magnetic component assembly including a magnetic core having a side with a stepped external surface, a coil within the magnetic core, and terminal clips for making electrical connections to the ends of the coil. The ends of the coil extend through the stepped external surface, the terminal clips attach to the stepped external surface, and the external surface is mounted to a circuit board to complete electrical connection with improved reliability. Smaller component sizes with improved manufacturability and consistency result.

39 Claims, 13 Drawing Sheets

SURFACE MOUNT MAGNETIC COMPONENT ASSEMBLY

CROSS REFERENCE TO RELATED APPLICATIONS

The present application relates to the following patent commonly owned U.S. patent application Ser. No. 12/247,281 filed on Oct. 8, 2008 and entitled "High Current Amorphous Powder Core Inductor"; U.S. patent Ser. No. 12/181,436 filed Jul. 29, 2008 and entitled "A Magnetic Electrical Device"; and U.S. Provisional Patent Application No. 61/080,115 filed Jul. 11, 2008 and entitled "High Performance High Current Power Inductor", the disclosures of which are hereby incorporated by reference in their entirety.

BACKGROUND OF THE INVENTION

The field of the invention relates generally to surface mount electronic components and their manufacture, and more specifically to magnetic components such as inductors and transformers.

With advancements in electronic packaging, the manufacture of smaller, yet powerful electronic devices, has become possible. To enable reductions in size of such devices, electronic components have been increasingly miniaturized. Manufacturing electronic components to meet such requirements presents many difficulties, thereby making the manufacturing process expensive.

Manufacturing processes for magnetic components such as inductors and transformers, like other components, have been scrutinized as a way to reduce costs in the highly competitive electronics manufacturing business. Reduction of manufacturing costs is particularly desirable when the components being manufactured are low cost, high volume components. In a high volume component, any reduction in manufacturing cost is, of course, significant.

BRIEF DESCRIPTION OF THE INVENTION

In one aspect, a surface mount magnetic component assembly is disclosed having a magnetic core defining at least one external side having a stepped surface, a conductive coil internal to the magnetic core, the coil including first and second ends, and at least one of the first and second ends extending through the at least one side. The component may be surface mounted to a circuit board via the external side having the stepped surface, with numerous advantages over conventional designs.

In another aspect, a surface mount magnetic component assembly is disclosed including a magnetic core defining at least one external side with first, second, third and fourth corners and having a stepped surface; a conductive coil internal to the magnetic core, the coil including first and second ends, at least one of the first and second ends extending through the at least one external side; and first and second terminal clips coupled to the stepped surface and respectively connecting to the first and second ends of the coil. The terminal clips may be surface mounted to a circuit board with the external side resting on the circuit board, with numerous advantages over conventional magnetic component designs.

A variety of stepped surfaces and a variety of terminal clip configurations are disclosed which nest and mate with the respective stepped surfaces, and provide improved electrical connections between the coil ends and the terminal clips while offering lower component footprints and lower profiles on a circuit board. Electrical connections may be established between the coil ends and sections of the terminal clips either externally or internally to the core structure. Different magnetic core configurations including single piece and multiple piece cores are described with different coil configurations in numerous embodiments.

DETAILED DESCRIPTION OF THE INVENTION

Figure 1:
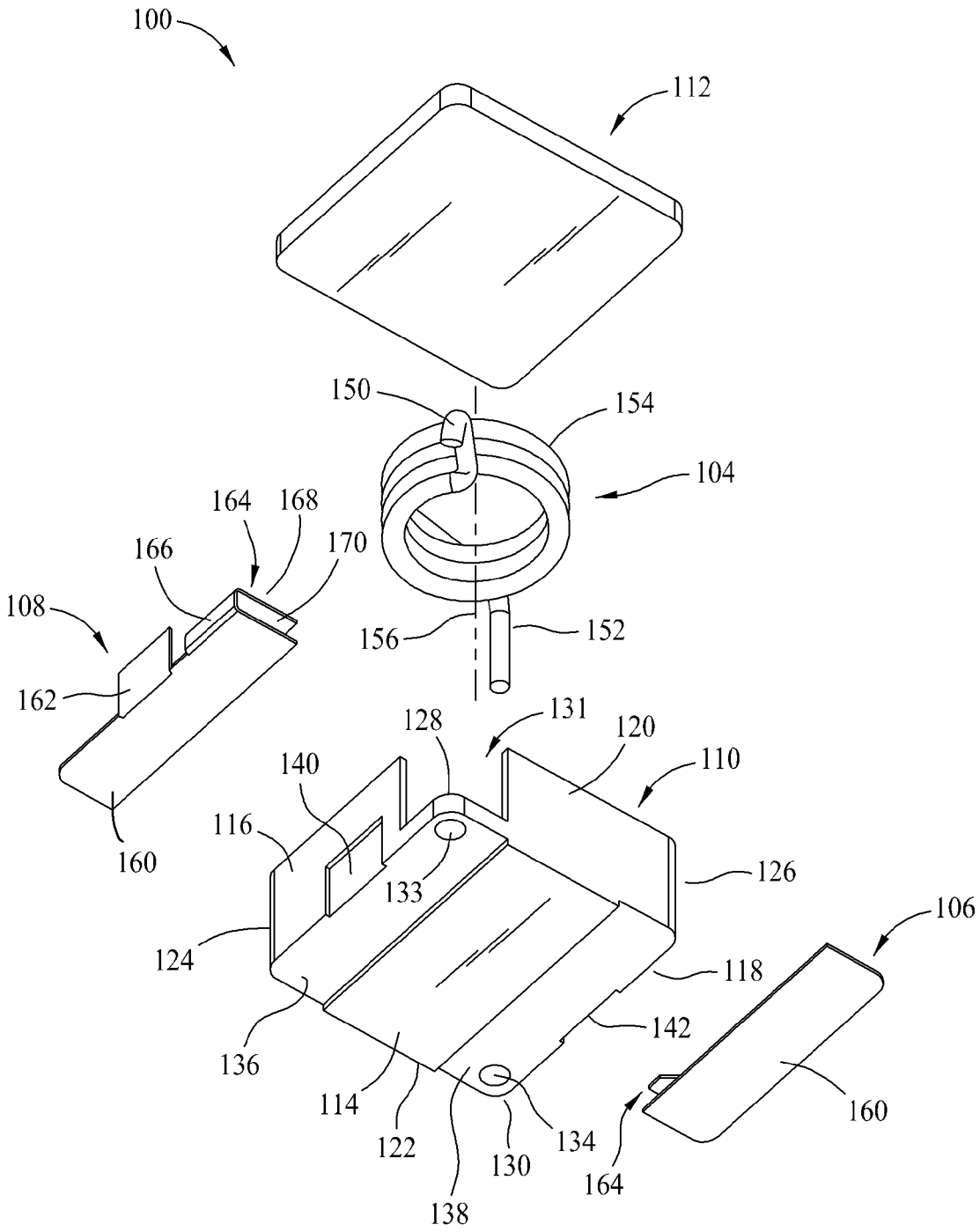
FIG. 1 is an exploded view of a first exemplary surface mount magnetic component according to an exemplary embodiment of the invention.

Exemplary embodiments of inventive electronic component designs are described herein that overcome numerous difficulties in the art. To understand the invention to its fullest extent, the following disclosure is presented in different segments or parts, wherein Part I discusses particular problems and difficulties, and Part II describes exemplary component constructions and assemblies for overcoming such problems.

I. Introduction to the Invention

Conventional magnetic components such as inductors for circuit board applications typically include a magnetic core and a conductive winding, sometimes referred to as a coil, within the core. The core may be fabricated from discrete core pieces fabricated from magnetic material with the winding placed between the core pieces. Various shapes and types of core pieces and assemblies are familiar to those in the art, including but not necessarily limited to U core and I core assemblies, ER core and I core assemblies, ER core and ER core assemblies, a pot core and T core assemblies, and other matching shapes. The discrete core pieces may be bonded together with an adhesive and typically are spaced or gapped from one another.

In some known components, for example, the coils are fabricated from a conductive wire that is wound around the core or a clip. That is, the wire may be wrapped around a core piece, sometimes referred to as a drum core or other bobbin core, after the core pieces has been completely formed. Each free end of the coil may be referred to as a lead and may be used for coupling the inductor to an electrical circuit, either via direct attachment to a circuit board or via an indirect connection through a terminal clip. Especially for small core pieces, winding the coil in a cost effective and reliable manner is challenging. Hand wound components tend to be inconsistent in their performance. The shape of the core pieces renders them quite fragile and prone to core cracking as the coil is wound, and variation in the gaps between the core pieces can produce undesirable variation in component performance. A further difficulty is that the DC resistance ("DCR") may undesirably vary due to uneven winding and tension during the winding process.

In other known components, the coils of known surface mount magnetic components are typically separately fabricated from the core pieces and later assembled with the core pieces. That is, the coils are sometimes referred to as being pre-formed or pre-wound to avoid issues attributable to hand winding of the coil and to simplify the assembly of the magnetic components. Such pre-formed coils are especially advantageous for small component sizes.

In order to make electrical connection to the coils when the magnetic components are surface mounted on a circuit board, conductive terminals or clips are typically provided. The clips are assembled on the shaped core pieces and are electrically connected to the respective ends of the coil. The terminal clips include generally flat and planar regions that may be electrically connected to conductive traces and pads on a circuit board using, for example, known soldering techniques. When so connected and when the circuit board is energized, electrical current may flow from the circuit board to one of the terminal clips, through the coil to the other of the terminal clips, and back to the circuit board. Current flow through the coil induces magnetic fields and energy in the magnetic core.

A number of practical issues are presented with regard to making the electrical connection between the coil and the terminal clips. A rather fragile connection between the coil and terminal clips is typically made external to the core and is consequently vulnerable to separation. In some cases, it is known to wrap the ends of coil around a portion of the clips to ensure a reliable mechanical and electrical connection between the coil and the clips. This has proven tedious, however, from a manufacturing perspective and easier and quicker termination solutions would be desirable. Additionally, wrapping of the coil ends is not practical for certain types of coils, such as coils having rectangular cross section with flat surfaces that are not as flexible as thin, round wire constructions.

As electronic devices continue recent trends of becoming increasingly powerful, magnetic components such as inductors are required to conduct increasing amounts of current. As a result the wire gauge used to manufacture the coils is typically increased. Because of the increased size of the wire used to fabricate the coil, when round wire is used to fabricate the coil the ends are typically flattened to a suitable thickness and width to satisfactorily make the mechanical and electrical connection to the terminal clips using for example, soldering, welding, or conductive adhesives and the like. The larger the wire gauge, however, the more difficult it is to flatten the ends of the coil to suitably connect them to the terminal clips. Such difficulties have resulted in inconsistent connections between the coil and the terminal clips that can lead to undesirable performance issues and variation for the magnetic components in use. Reducing such variation has proven very difficult and costly.

Fabricating the coils from flat, rather than round conductors may alleviate such issues for certain applications, but flat conductors tend to be more rigid and more difficult to form into the coils in the first instance and thus introduce other manufacturing issues. The use of flat, as opposed to round, conductors can also alter the performance of the component in use, sometimes undesirably. Additionally, in some known constructions, particularly those including coils fabricated from flat conductors, termination features such as hooks or other structural features may be formed into the ends of the coil to facilitate connections to the terminal clips. Forming such features into the ends of the coils, however, can introduce further expenses in the manufacturing process.

Recent trends to reduce the size, yet increase the power and capabilities of electronic devices present still further challenges. As the size of electronic devices are decreased, the size of the electronic components utilized in them must accordingly be reduced, and hence efforts have been directed to economically manufacture power inductors having relatively small, sometimes miniaturized, structures despite carrying an increased amount of electrical current to power the device. The magnetic core structures are desirably provided with lower and lower profiles relative to circuit boards to allow slim and sometimes very thin profiles of the electrical devices. Meeting such requirement presents still further difficulties.

Efforts to optimize the footprint and the profile of magnetic components are of great interest to component manufacturers looking to meet the dimensional requirements of modern electronic devices. Each component on a circuit board may be generally defined by a perpendicular width and depth dimension measured in a plane parallel to the circuit board, the product of the width and depth determining the surface area occupied by the component on the circuit board, sometimes referred to as the "footprint" of the component. On the other hand, the overall height of the component, measured in a direction that is normal or perpendicular to the circuit board, is sometimes referred to as the "profile" of the component. The footprint of the components in part determines how many components may be installed on a circuit board, and the profile in part determines the spacing allowed between parallel circuit boards in the electronic device. Smaller electronic devices generally require more components to be installed on each circuit board present, a reduced clearance between adjacent circuit boards, or both.

However, many known terminal clips used with magnetic components have a tendency to increase the footprint and/or the profile of the component when surface mounted to a circuit board. That is, the clips tend to extend the depth, width and/or height of the components when mounted to a circuit board and undesirably increase the footprint and/or profile of the component. Particularly for clips that are fitted over the external surfaces of the magnetic core pieces at the top, bottom or side portions of the core, the footprint and/or profile of the completed component may be extended by the terminal clips. Even if the extension of the component profile or height is relatively small, the consequences can be substantial as the number of components and circuit boards increases in any given electronic device.

Figure 18:
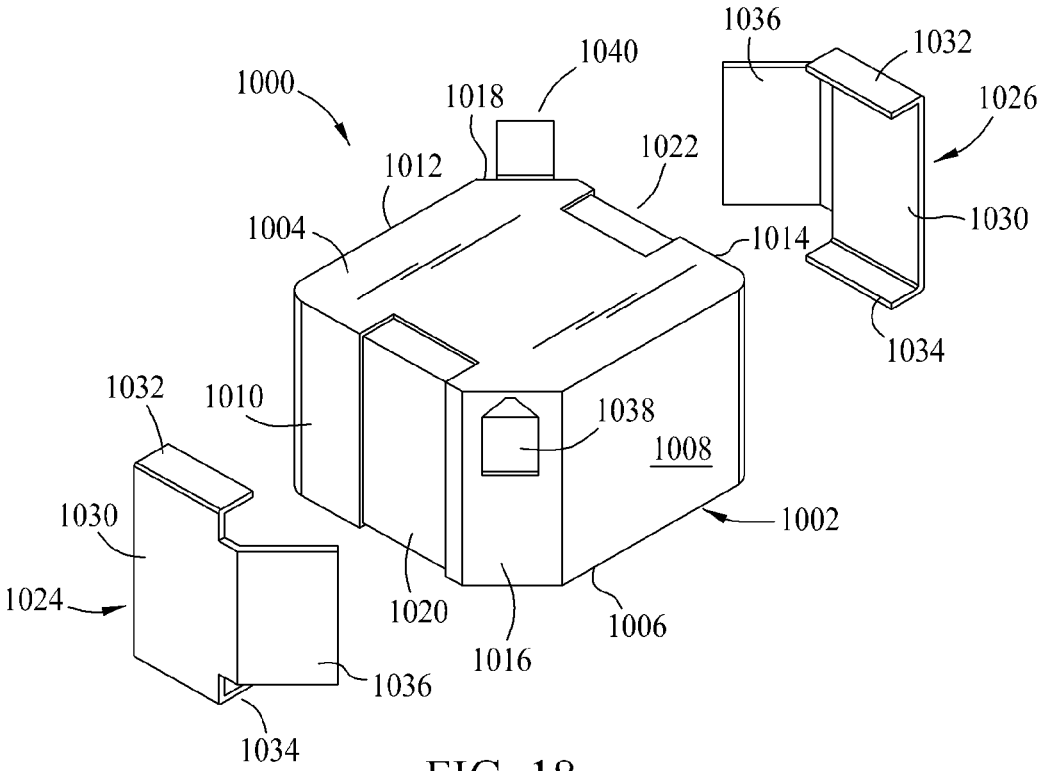
FIG. 18 PRIOR ART
FIG. 18 is a partial exploded view of a known surface mount magnetic component.
Figure 19:
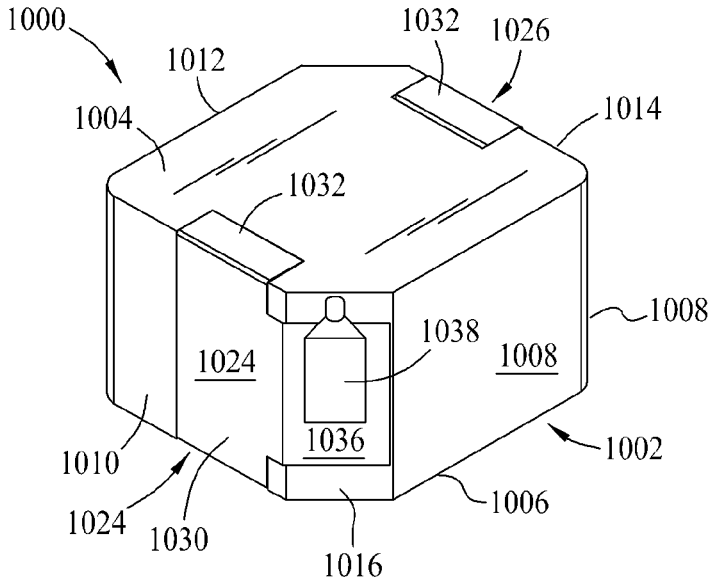
FIG. 19 PRIOR ART
FIG. 19 is a perspective assembly view of the magnetic component shown in FIG. 18.

FIGS. 18 and 19 illustrate a known magnetic component construction intended to address many of the concerns noted above. As shown in FIGS. 18 and 19, a surface mount component 1000 includes a magnetic core 1002 defined by opposing top and bottom sides 1004 and 1006, and opposing lateral sides 1008, 1010, 1012 and 1014 collectively providing a generally rectangular or cubic structure. Opposing tapered sides 1016 and 1018 are located on diagonally opposed portions of the core 1002, with the tapered sides 1016 and 1018 extending respectively between the lateral sides 1008 and 1010 and between the lateral sides 1012 and 1014. The intersection of the lateral sides 1010 and 1012, and also the lateral sides 1008 and 1004 includes gently rounded corners.

The lateral sides 1010 and 1014, and also portions of the top and bottom sides 1004 and 1006, include recessed portions 1020 and 1022 that respectively receive shaped terminal clips 1024 and 1026 fabricated from a conductive material. As shown in FIGS. 18 and 19, the terminal clips 1024 and 1026 each include a side section 1030, a top section 1032 and a bottom section 1034 generally formed orthogonal to one another to define a C-shaped channel or receiving area between the top and bottom sections 1032 and 1034. The receiving area is fitted over the recessed portions 1022 and 1022 in the respective top side 1004, bottom side 1006, and lateral sides 1010 and 1014 of the core 1002. The terminal clips 1024 and 1026 further include an angle section 1036 extending from the side section 1030 that overlie the tapered sides 1016 and 1018 of the core 1002. One or more of the clip sections 1030, 1032, 1034, 1036 of the terminal clips 1024, 1026 may be adhered or otherwise bonded to the core 1002 to retain the clips 1024 and 1026 to the core 1002.

Figure 20:
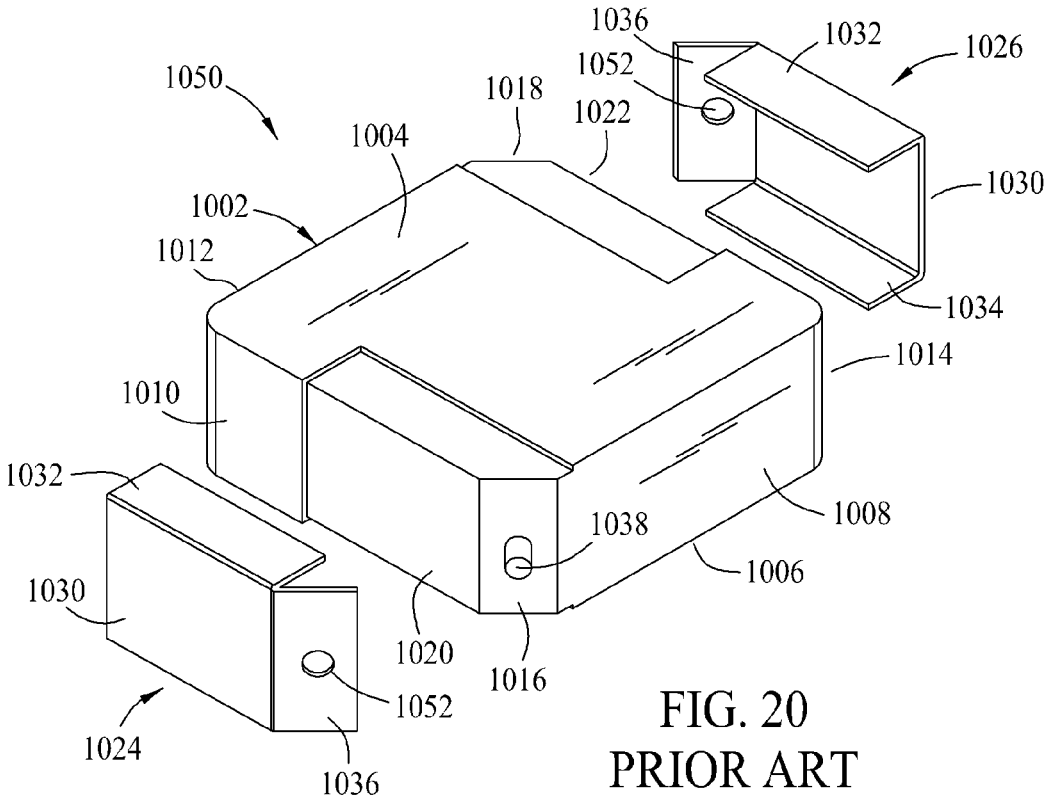
FIG. 20 PRIOR ART
FIG. 20 is a partial exploded view of another known surface mount magnetic component.

Opposed ends or leads 1038 and 1040 of a coil are shown protruding from the tapered sides 1016 and 1018 of the core, with the remainder of the coil embedded in the core 1002. The coil may be an inductor coil including a number of turns, embedded in the core 1002, to achieve a desired inductance value for the component 1000. As shown in FIGS. 19 and 20, the coil is fabricated from a flat conductor and accordingly the opposed ends 1038 and 1040 are generally flat and suitable for surface attachment to the terminal clips 1024 and 1026 via the angle sections 1036 thereof via soldering techniques, for example. As shown in FIG. 19, mechanical features such as slots may be provided in the angle sections 1036, and the coil ends 1038, 1040 may be extended through the slots for additional mechanical reinforcement. As shown, some shaping of the leading edge of the coil ends 1024 and 1026, namely tapering the leading edge to facilitate its insertion through the slot in the clip angle section 1036, may be desirable to facilitate assembly of the component 1000.

Figure 21:
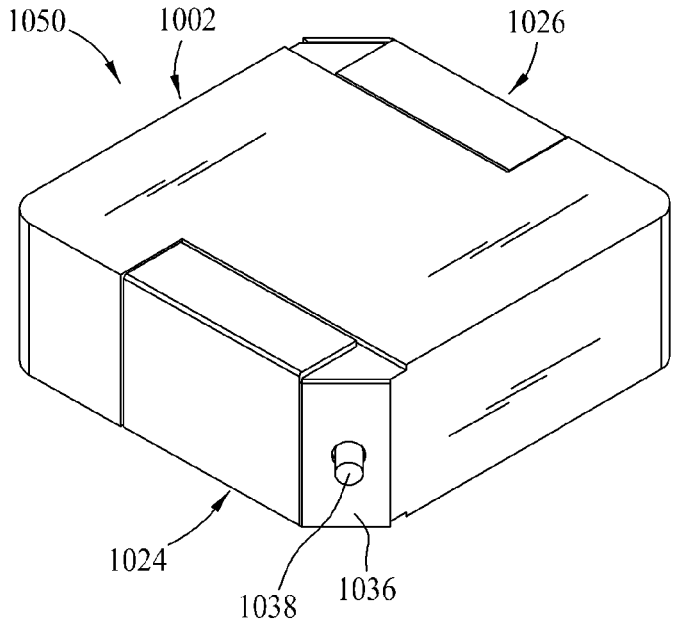
FIG. 21 PRIOR ART
FIG. 21 is a perspective assembly view of the magnetic component shown in FIG. 20.

FIGS. 20 and 21 illustrate another known magnetic component construction 1050 having a lower profile but essentially similar construction to the component 1000. Like features between the components 1000 and 1050 are accordingly shown with like reference characters.

Unlike the component 1000, the component 1050 includes a coil embedded in the core 1002 that is fabricated from a round wire, and hence the coil ends 1038, 1040 protruding from the tapered sides 1016 and 1018 of the core 1002 are not flattened but are rounded like the remainder of the coil. To accommodate the coil ends 1038, 1040, the angle sections 1036 of the respective clips 1024 and 1026 include complementary through holes 1052 that receive the respective coil ends 1038, 1040. The coil ends 1038 and 1040 may then be soldered to the angle sections 1036 of the clips 1024 and 1026.

In use, either of the components 1000 or 1050 may be surface mounted to a conductive trace or pad on a circuit board via either the top or bottom section 1032 and 1032 of the terminal clips 1024 and 1026 via known soldering techniques or other techniques known in the art. When so connected, a conductive path is established, for example, from the circuit board to the bottom section 1034 of the terminal clip 1024, from the bottom section 1034 to the side section 1030 of the terminal clip 1024, from the side section 1034 to the angle section 1036 of the terminal clip 1024, from the angle section 1034 of the terminal clip 1024 to the coil end 1038, from the coil end 1038 through the coil to the opposing coil end 1040, from the coil end 1040 to the angle section 1036 of the terminal clip 1026, from the angle section 1036 of the terminal clip 1026 to the side section 1030 of the terminal clip 1026, from the side section 1030 to the bottom section 1034 of the terminal clip 1026, and from the bottom section 10234 of the terminal clip 1026 to the circuit board.

The components 1000 and 1050 are advantageous in several aspects as they are easier to assemble than many conventional inductor components. The coil ends 1038 and 1040 are generally exposed on the external surface of the core 1002 for ease of making soldered connections and the like to create electrical connection between the coil ends 1038, 1040 and the terminal clips 1024, 1026. The channel shaped clips 1024 and 1026 are relatively straightforward to apply, and the recessed portions 1020 and 1022 in the core prevent the terminal clips 1024, 1026 from extending the overall profile and footprint of the device.

The components 1000 and 1050 are not without their drawbacks, however. Exposure of the coil ends 1038, 1040 outside the core 1002 can be a liability in that the soldered connections between the coil ends 1038, 1040 and the terminal clips 1024, 1026 are generally exposed and unprotected on the tapered sides 1016, 1018 of the core 1002 before and after the components are installed. Hence, the soldered connections are vulnerable to being damaged or compromised as the components are handled during manufacturing processes, during transit to an installation location, during installation procedures of the magnetic components or other components on circuit boards, and during service and repair procedures. It would be desirable to provide more secure connections between the clips and the coil ends.

Also, while the recessed portions 1020 and 1022 in the core tend to preserve the overall profile and footprint of the device, as the wire gauge of used to fabricate the coil increases, adequate connection of the coil ends 1038, 1040 to the terminal clips 1024, 1026 on the tapered sides 1016, 1018 of the core 1002 may easily cause the connections to extend beyond a desired profile or footprint of the device.

Still further, the channel shaped terminal clips 1024 and 1026 that wrap around three sides of the core are also relatively large, and a rather long conductive path is created through the clips 1024 and 1026 from the circuit board to the coil ends 1038, 1040. The size of the clips 1024, 1026 and the length of the conductive path contributes to the electrical resistance of the components 1000, 1050 and associated power losses. It would be desirable to reduce the electrical resistance of the clips for such a device II. Exemplary Inventive Magnetic Component Constructions Disclosed are embodiments of surface mount magnetic components having unique core shapes and terminal clip configurations to avoid the problems discussed above, among other problems facing those in the art. The unique core shape and clip configurations facilitate an even more compact, consistent, robust, higher power and energy density components while offering smaller footprints and reduced manufacturing costs. Magnetic components of increased efficiency and improved manufacturability may be provided without increasing the size of the components and occupying an undue amount of space, especially when used on circuit board applications. Manual manufacturing steps associated with conventional component assemblies are avoided in favor of automating more of the steps in the manufacturing process so that more consistent and reliable products may be produced. While exemplary embodiments are described in the context of inductor components, it is recognized that other magnetic components such as transformers may likewise benefit from the concepts described below.

Figure 2:
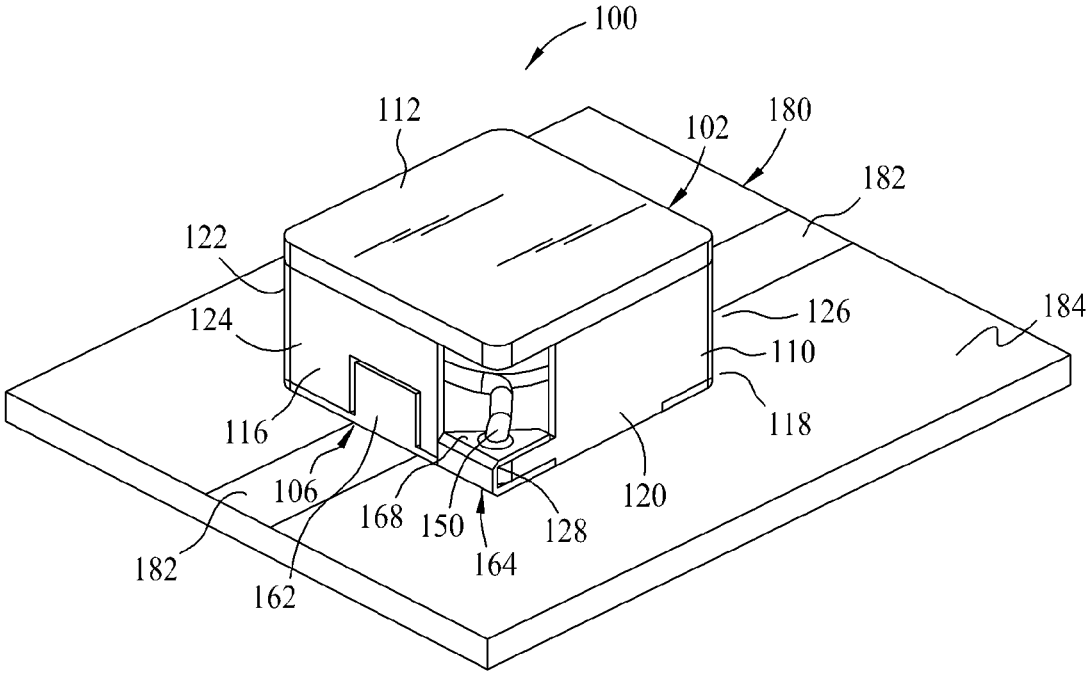
FIG. 2 is a top perspective assembly view of the magnetic component shown in FIG. 1.
Figure 3:
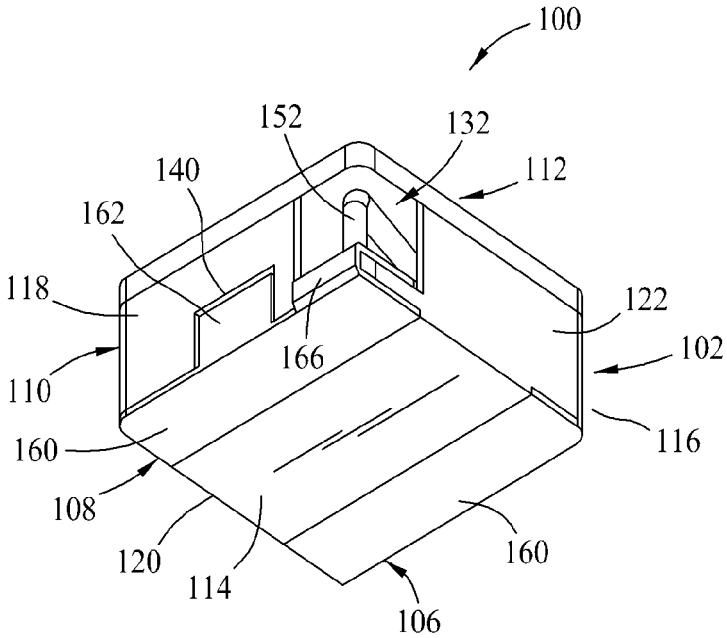
FIG. 3 is a bottom perspective assembly view of the magnetic component shown in FIG. 1.

FIGS. 1-3 illustrate a first embodiment of a surface mount magnetic component 100 according to an exemplary embodiment of the invention. FIG. 1 illustrates the component 100 in an exploded view, FIG. 2 illustrates the component 100 in a top perspective assembly view, and FIG. 3 illustrates the component 100 in a bottom perspective assembly view.

As shown in FIGS. 1-3, the component 100 includes a magnetic core 102, a coil 104 generally contained in the core 102, and terminal clips 106, 108.

In the exemplary embodiment illustrated in FIGS. 1-3, the core 102 is fabricated in discrete pieces, namely a first core piece 110 and a second core piece 112 that are assembled with the coil 104 such that the core pieces 110, 112 collectively define an enclosure containing the coil 104. The core pieces 110 and 112 may be formed in advance and bonded to one another in a gapped or spaced relation as the component 100 is assembled. The core pieces 110 and 112 and may be fabricated from a suitable magnetic material known to those in the art, including but not limited to ferromagnetic materials and ferrimagnetic materials, according to known techniques. In an alternative embodiment, however, it is appreciated that the core 102 may be fabricated as an integral piece if desired using, for example, iron powder materials or amorphous core materials, also known in the art, that may be pressed around the coil 104. Such iron powder materials and amorphous core materials may exhibit distributed gap properties that avoid any need for a physical gap in the core structure.

As shown in the illustrated embodiment, the first core piece 110 is formed into a generally rectangular body having a base wall 114 and a plurality of generally orthogonal side walls 116, 118, 120 and 122 extending from the lateral edges of the base wall 114. In the embodiment shown in FIGS. 1-3, the base wall 114 may sometimes be referred to as a bottom wall. The side walls 116 and 118 oppose one another and may sometimes be referred to as a left side a right side, respectively. The walls 120 and 122 oppose one another and may sometimes be referred to as a front side a rear side, respectively. The side walls 116, 118, 120 and 122 define an enclosure or cavity above the base wall 114 that generally contains the coil 104 when the component is assembled.

Further, the side walls 116 and 122 meet one another at a first corner 124 and the side walls 118 and 120 meet one another at a second corner 126 that is diagonally opposite the first corner 124 in the first core piece 110. Third and fourth corners 128 and 130 are also formed in the base wall 114 and are located opposite the corners 124 and 126 along the corresponding edges of the bottom wall 114. The side walls 116 and 120 are truncated and do not extend the third corner 128, and the side walls 118 and 122 are truncated and do not extend to the fourth corner 130. That is, the side walls 116 and 120 do not meet at the third corner 128 and an open space or window 131 (FIGS. 1 and 2) is thereby provided above the base wall 114 at the corner 128 between the side walls 116 and 120. Likewise, the side walls 118 and 122 do not meet at the fourth corner 130 and an open space or window 132 (FIG. 3) is thereby provided above the base wall 114 at the corner 130 between the side walls 118 and 122. The third and fourth corners 128 and 130 are diagonally opposite one another on the base wall 114, and the windows 131, 132 at each corner 128 and 130 each provide access to the core interior at their respective locations. More specifically, access to the core interior is provided via the windows 131, 132 above the base wall 114 from two side edges of the base wall 114 to facilitate termination of the coil 104 to the terminal clips 106 and 108, respectively. A through hole 133, 134 extending completely through a thickness of the base wall 114 is provided proximate the respective third and fourth corners 128, 130 to facilitate connection to the coil 104 to the terminal clips 106, 108 as further described below.

The base wall 114 of the first core piece 110 includes an external surface that is stepped to receive the terminal clips 106 and 108. The stepped external surface includes, as shown in FIGS. 1, depressed or recessed surfaces 136, 138 extending in a generally coplanar relationship to one another. The depressed surface 136 extends beneath the side wall 116 and extends an entire distance or length along the base wall 114 from the first corner 124 to the third corner 128. The depressed surface 138 extends beneath the side wall 118 and extends an entire distance or length along the base wall 114 from the second corner 126 to the fourth corner 130. The depressed surfaces 136, 138 extend opposite one another and are separated from one another by a portion of the base wall that does not include a depressed surface, and hence is elevated relative to the depressed surfaces 136, 138. Alternatively stated, the depressed surfaces 136, 138 extend in a first plane generally parallel to, but spaced from, a second plane corresponding to the remainder of the base wall surface extending between the depressed surfaces 136 and 138. The through holes 133 and 134 are respectively located in the depressed surfaces 136, 138 adjacent the corners 128 and 130.

As also shown in FIG. 1, the side wall 116 of the first core piece 110 also includes a depressed surface 140, and the opposing side wall 118 includes a corresponding depressed surface 142. The depressed surfaces 140 and 142 extend only a partial distance along a length of the respective side walls 116 and 118 between the corners 124 and 128 and the corners 126 and 130. The depressed surfaces 140 and 142 also extend upward from the base wall 114 for a distance less than the height of the side walls 116 and 118 measured in a direction perpendicular to the bottom surface. As such, the depressed surfaces 140 and 142 are spaced from top edges of the side walls 116 and 118 while adjoining the depressed surfaces 136 and 138 of the base wall 114 for a portion of the length of the side walls 116 and 118 extending adjacent the base wall 114.

Unlike the first core piece 110, the second core piece 112 is generally flat and planar on both opposing major surfaces, and is sized and dimensioned to complement the base wall 114 of the first core piece 110 and complete the enclosure of the first core piece 110 with the coil 104 situated between the first core piece 110 and the second core piece 112.

As best seen in FIG. 1, the coil 104 is fabricated from a length of round wire having a first end or lead 150, a second end or lead 152 opposing the first end, and a winding portion 154 between the coil ends 150 and 152 wherein the wire is wound about a coil axis 156 for a number of turns to achieve a desired effect, such as, for example, a desired inductance value for a selected end use application of the component. The ends 150, 152 are bent relative to the winding portion 154 so that the ends extend parallel to the coil axis 156 to facilitate termination of the coil ends 150, 152 as explained below. While one coil is illustrated in the embodiment shown, it is appreciated that in other embodiments more than one coil may be provided.

If desired, the wire used to form the coil 104 may be coated with enamel coatings and the like to improve structural and functional aspects of coil 104. As those in the art will appreciate, an inductance value of coil 104, in part, depends upon wire type, a number of turns of wire in the coil, and wire diameter. As such, inductance ratings of the coil 104 may be varied considerably for different applications. The coil 104 may be fabricated independently from the core pieces 110 and 112 using known techniques and may be provided as a pre-wound structure for assembly of the component 100. In an exemplary embodiment, the coil 104 is formed in an automated manner to provide consistent inductance values for the finished coils, although alternatively the coils may be wound by hand if desired. It is understood that if more than one coil is provide, additional terminal clips may likewise be required to make electrical connections to all of the coils utilized.

The exemplary terminal clips 106 and 108 shown in FIG. 1 are substantially identical in construction but reversed 1800 when applied to the first core piece 110 and hence extend as mirror images of one another. Each terminal clip 106 and 108 includes, as best seen in FIG. 1, a generally flat and planar bottom section 160, an upright locating tab section 162 extending perpendicularly to the bottom section 160, and a termination section 164 coupled to the bottom section and spaced from the locating tab section 162. The bottom sections 160 are formed as an elongated strip dimensioned to be received in one of the depressed portions 136 or 138, and the locating tab section are shaped and dimensioned to be received in the depressed surfaces 140, 142 in the side walls 116 and 118 of the first core piece 110. The terminal clips 106 and 108 shown in FIGS. 1-3 are bilaterally asymmetrical in shape, with the locating tab section 162 approximately centered along the length of the elongated bottom section 160, and the termination section 164 located at one end of the elongated bottom section 160.

The termination section 164 of each clip 106, 108 may include as shown in FIG. 1 an extension section 166 extending perpendicularly from one lateral edge of the bottom section 160, and a generally planar coil section 168 extending from the extension section 166 in a manner generally parallel to, but spaced from, the plane of the bottom section 160. An engagement slot 170 is formed between the bottom section 160 and the coil section 168 that may be inserted over and engaged to the base wall 114 of the first core piece 110 adjacent one of the corners 128 and 130.

The terminal clips 106, 108 and all the sections thereof as described can be manufactured in a relatively straightforward manner by cutting, bending, or otherwise shaping the clips 106 and 108 from a conductive material. In one exemplary embodiment, the terminals are stamped from a plated sheet of copper and bent into final form, although other materials and formation techniques may alternatively be utilized. The clips 106, 108 may be pre-formed and assembled to the core piece 110 at a later stage of production.

When assembled to the first core piece 110, the coil section 168 extends through a lower portion of the window 131 and 132 adjacent each corner 128 and 130 with the corners 128 and 130 of the first core piece 110 received in engagement slot 170 of each terminal clip 106 and 108. As such, the coil section 168 and the bottom section 160 of each clip 106, 108 extend on opposite sides of the base wall 114. The bottom section 160 extends on the exterior side of the base wall 114 and the coil section 168 extends on the interior side of the base wall 114. Each coil section 168 of the clips 106 and 108 includes a through hole (not visible in FIGS. 1-3) that align with the through holes 133 and 134 in the base wall 114 proximate the corners 128 and 130. The coil ends 150, 152 may therefore be extended through the respective through holes 133, 134 and the through holes in the coil sections 168 of the clips 106 and 108. However, the bottom section 160 of each clip 106, 108 does not include a through hole such that the distal portions of the coil ends 150, 152 are not exposed on the exterior side of the base wall 114 when the component 100 is assembled.

With the clips 106 and 108 assembled to the core piece 110 and the coil ends 150, 152 extended through the through holes 133, 134 and the through holes in the coil sections 168, electrical connections may be secured by soldering the coil ends 150, 152 to the coil sections 168 via the access provided by the core windows 131, 132.

As seen in FIG. 2, the component 100 may then be surface mounted to a circuit board 180. The circuit board 180 includes conductive traces 182 defining circuit paths on a major surface 184 of the board 180. When the component 100 is mounted to the board 180 the base wall 114 faces and abuts the board surface 184 and the flat and planar bottom sections 160 of each terminal clip 106, 108 are electrically connected to the conductive traces 182 on the board 180 via soldering techniques or other techniques known in the art. A circuit path is therefore completed through the component 100 between the circuit traces 182. While one component 100 is shown mounted to the circuit board 180 on one side 184 of the board, it is understood that more than one component 100 may be mounted to the board on the same side or opposite side of the board 180. Likewise, it is understood that the component 100 is but one of many components of various types that are to be mounted to the circuit board 100 to complete electrical circuitry, and a plurality of circuit boards may be used in combination in any given electronic device.

The construction of the component 100 overcomes a number of difficulties that conventional component constructions present, including but not limited to the components shown in FIGS. 18-21 and described above. Numerous advantageous of the assembly of the component 100 over conventional surface mount component constructions include at least the following aspects.

First, the electrical connection between the coil ends 150 and 152 and the terminal clips 106 and 108, whether soldered or created otherwise using other known techniques, remains internal to the core structure, while the core windows 131, 132 provide access to make the connections. Because the coil and terminal clip connections themselves are internal to the core structure, they are much less susceptible to being inadvertently damaged or compromised during handling of the components.

Second, the internal electrical connections between the coil ends 150, 152 and the terminal clips 106, 108 ensures that the completed component will not occupy an undue amount of space on the circuit board 180 and that the footprint (i.e. the surface area that the component 100 occupies on the circuit board 180) and profile (i.e., the height of the component projection above the board 180) of the component will not vary in production. The depressed surfaces 136, 138, 140 and 142 of the core piece 110 further ensure the footprint and profile of the device are maintained.

Third, the through holes 133, 134 in the core and the coil sections 168 of the clips 106, 108 provide a double anchor for the coil ends 150 and 152 to secure them in place and retain them there. Thus, more secure connections can be made in the first instance, especially for larger wire gauges used to fabricate the coil 104 that can otherwise be difficult to terminate. Connections may be established without wrapping the coil ends around the clips and without hooks or other mechanical retention features, saving manufacturing time and expense while simplifying the electrical connection.

Fourth, because of the through holes 133, 134 in the core and the coil sections 168 of the clips 106, 108 anchoring the coil ends 150 and 152, termination of the coil ends 150, 152 to the clips may be accomplished without having to flatten or otherwise shape the coil ends 150, 152, which saves manufacturing steps when larger wire gauges are used.

Fifth, the terminal clips 106 and 108 are smaller and use less material than some known constructions, yet still rather easily assembled to the core. The engagement slot 170 and the locating tab 162 of the clips ensure proper positioning of the clips 106, 108 on the core piece 110. Using a reduced amount of material to form the clips 106, 108 in turn reduces manufacturing expense, and also tends to reduce the electrical resistance of the clips and reduces power losses for the component. The clips 106, 108 can be formed in a largely, if not entirely, automated manner for even further savings in manufacturing costs.

Sixth, the component 100 can be assembled rather quickly when the core 102, the coil 104 and the terminal clips 106 and 108 are pre-formed and provided for assembly. Because of the simplified electrical connections between the coil 104 and the clips 106, more components can be produced in less time.

Figure 4:
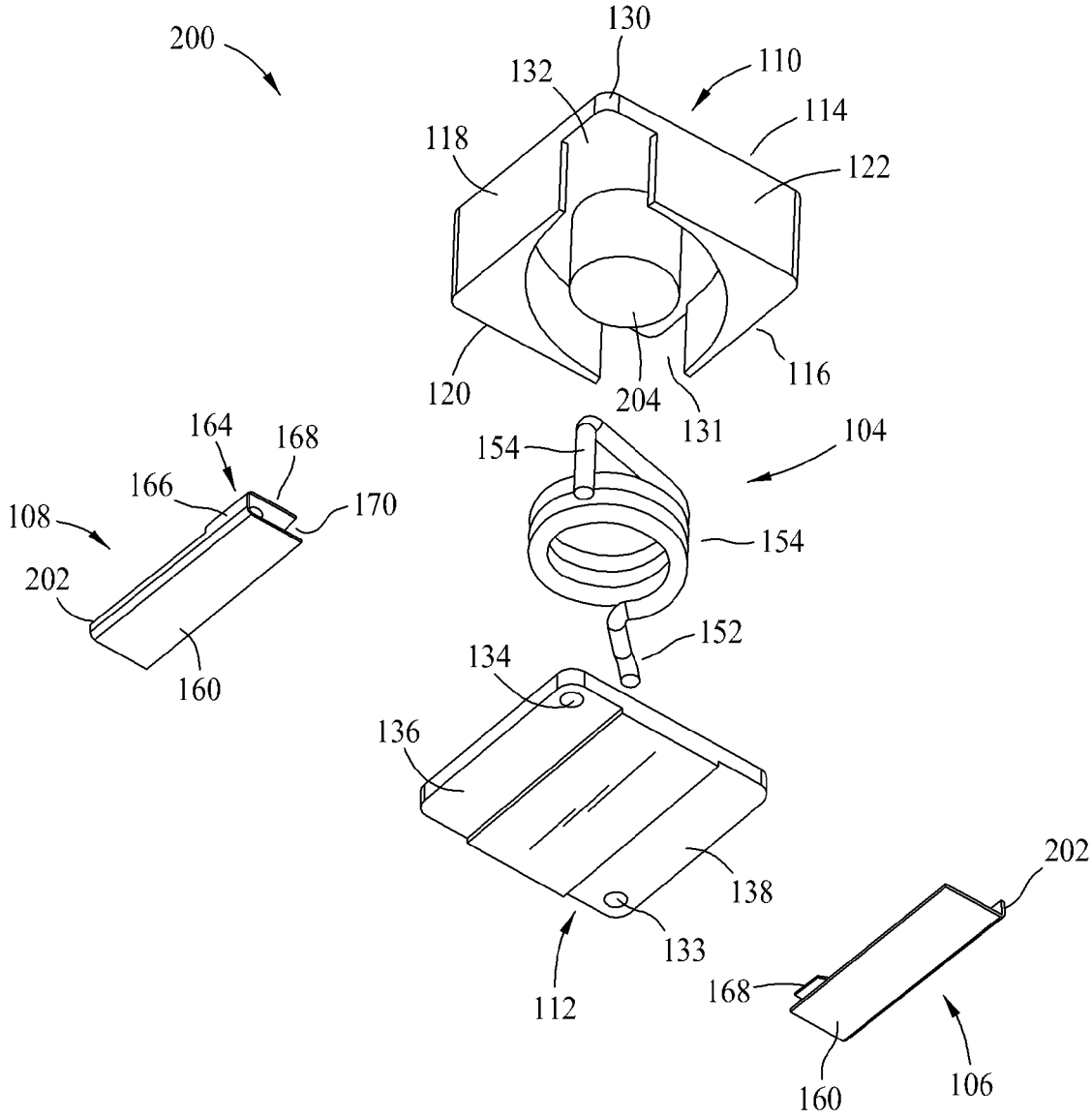
FIG. 4 is an exploded view of a second exemplary surface mount magnetic component according to an exemplary embodiment of the invention.
Figure 5:
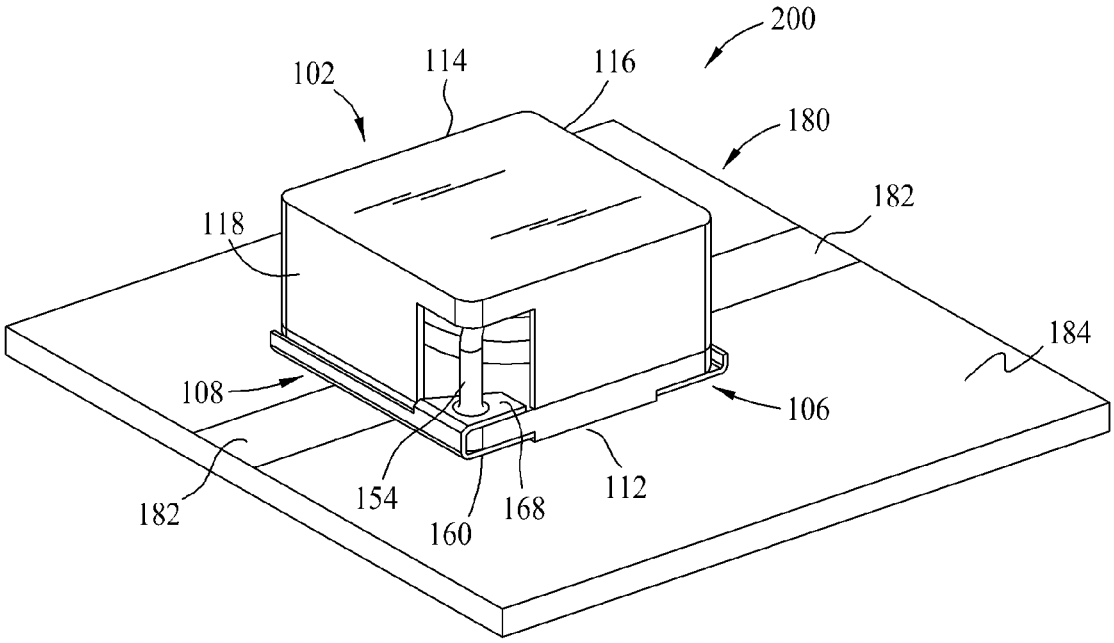
FIG. 5 is a top perspective assembly view of the magnetic component shown in FIG. 4.
Figure 6:
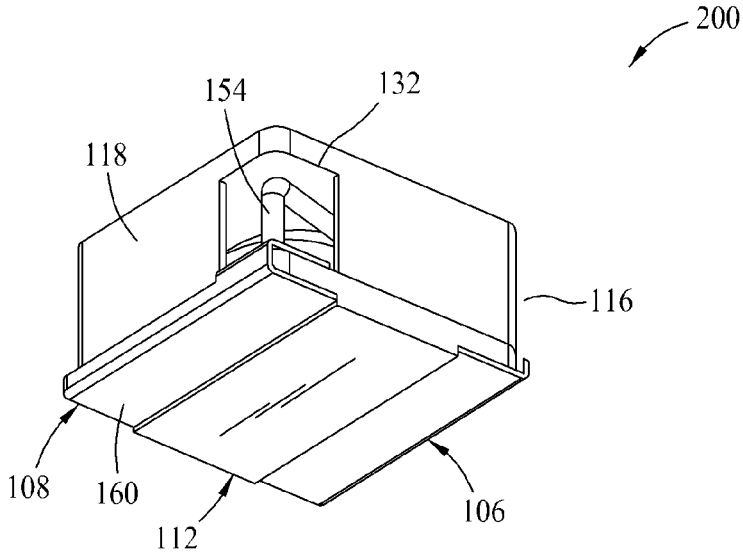
FIG. 6 is a bottom perspective assembly view of the magnetic component shown in FIG. 4.

FIGS. 4-6 are various views of a second exemplary surface mount magnetic component 200 according to an exemplary embodiment of the invention. FIG. 4 is an exploded view of the component 200, FIG. 5 is a top perspective assembly view of the component 200, and FIG. 6 is a bottom perspective assembly view of the component 200. The component 200 is similar to the component 100 in many aspects and like reference characters are utilized to denote like features in the components 100 and 200.

Comparing the components 100 and 200 in the Figures, it can be seen that the stepped external surface is provided in the second core piece 112. That is, the depressed surfaces 136, 138 and the through holes 133, 134 in the component 200 are provided in the second core piece 112 rather than in the first core piece 110 as described in relation to the component 100. The external surface of the second core piece 112 is shaped to include the depressed surfaces 136, 138 separated by a portion of the second piece 112 that is not depressed. The depressed surfaces 136, 138 are spaced apart from one another and extend generally parallel to one another. The depressed surfaces 136, 138 also extend co-planar to one another but are offset or spaced from the plane of the non-depressed surface of the second core piece 112 separating the depressed surfaces 136, 138. The base wall 114 of the first core piece 110, however, is generally flat and planar, and does not include depressed surfaces. Forming the depressed surfaces 136 and 138 in the second core piece 112 rather than the first core piece 110 can be a bit easier and can reduce costs to produce the component 200.

Additionally, the clips 106 and 108 in the component 200 do not include the locating tab section 162 described in relation to the component 100. Instead, the clips 106 and 108 in the component 200 include a rail section 202 that abuts the side edge of the second core piece 112 when installed. In the depicted embodiment, the rail sections 202 extend axially for an entire length of the bottom section 160 on each terminal clip 106, 108, and the rail sections 202 extend generally perpendicularly to the plane of the bottom sections 160 for a short distance above the bottom section 160. When the clips 106, 108 are installed, the rail sections 202 wrap around the side edges of the second core piece 112 but generally do extend to the side walls 116, 118 of the first core piece 110. Thus, the formation of the first core piece 110 may be further simplified as the side walls 116, 118 thereof need not include depressed surfaces.

As shown in FIG. 5, when the component 200 is mounted to the circuit board 180, the second core piece 112 faces and abuts the board surface 184 and the flat and planar bottom sections 160 of each terminal clip 106, 108 is electrically connected to the conductive traces 182 on the board 180 via soldering techniques or other techniques known in the art.

Also, as shown in FIG. 4, the first core piece 110 includes a centering projection or post 204 projecting from the base wall 114 of the first core piece 110. The post 204 facilitates a more precise position of the coil 104 relative to the first core piece 110 and allows for greater control over the inductance value of the component 200 in use. Of course, the post 204 could also be utilized in the component 100 (FIGS. 1-3) described above for similar reasons.

Except as noted above, the benefits of the component 200 are otherwise comparable to the component 100.

Figure 7:
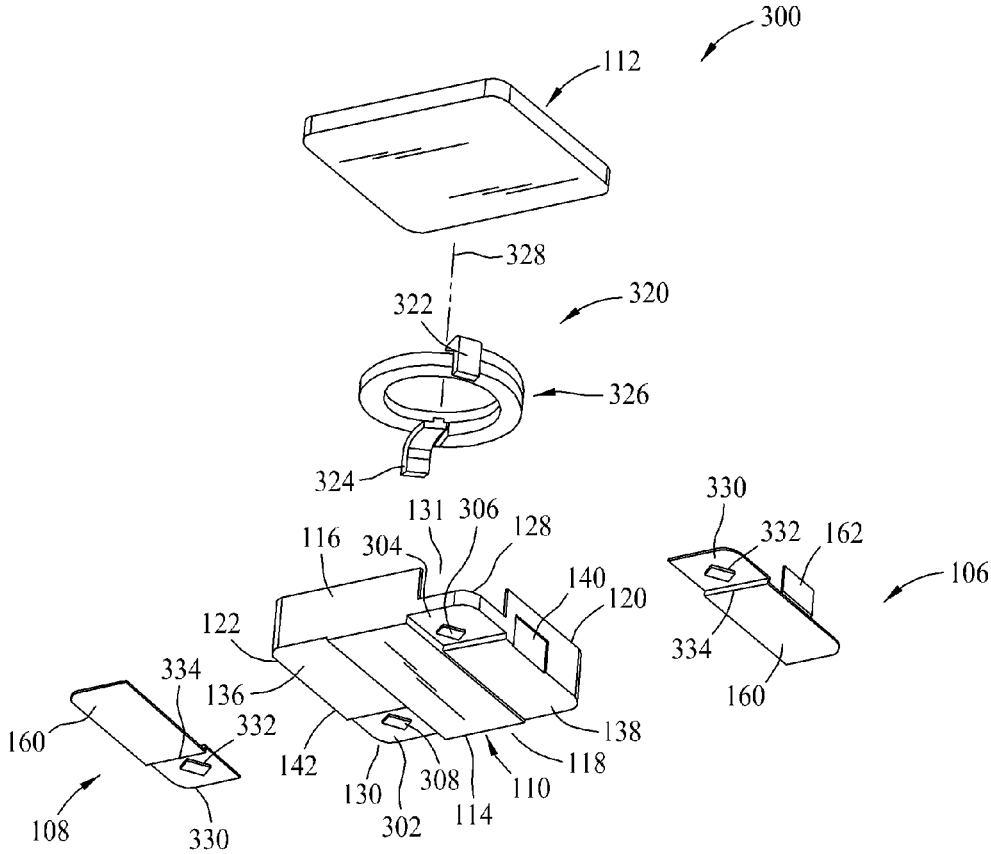
FIG. 7 is an exploded view of a third exemplary surface mount magnetic component according to an exemplary embodiment of the invention.
Figure 8:
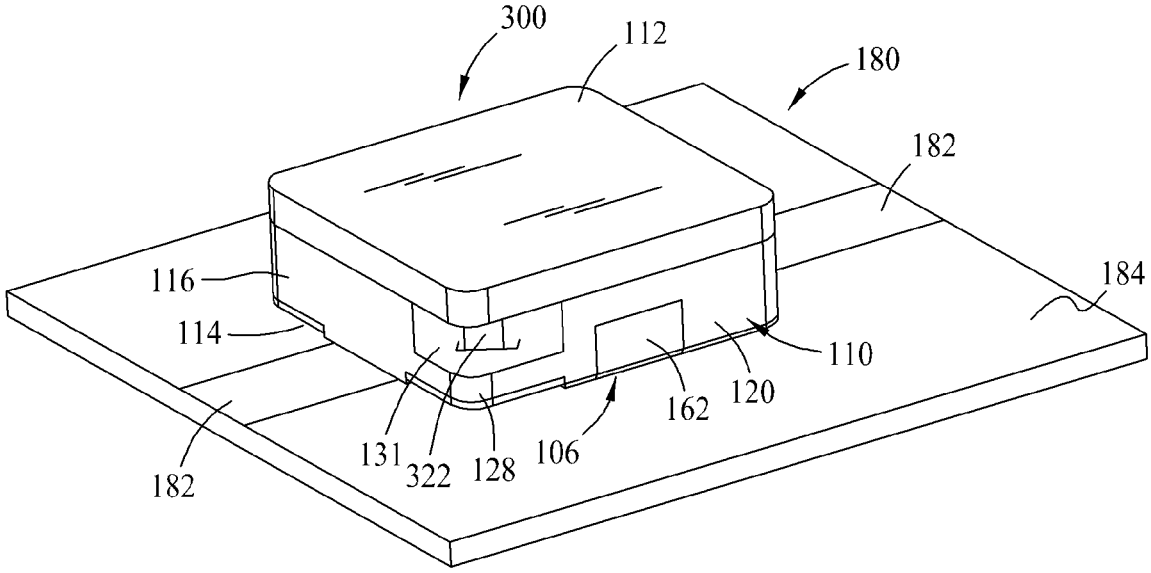
FIG. 8 is a top perspective assembly view of the magnetic component shown in FIG. 7.
Figure 9:
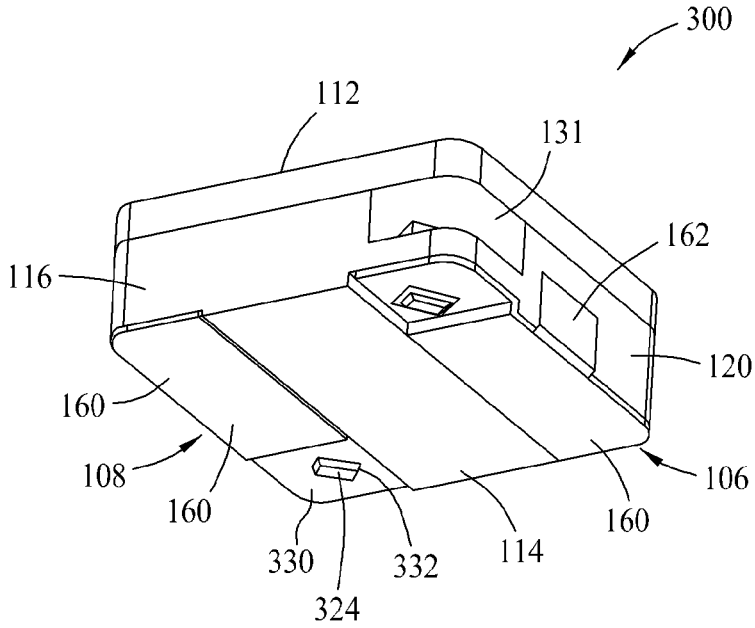
FIG. 9 is a bottom perspective assembly view of the magnetic component shown in FIG. 7.

FIGS. 7-9 are various views of a third exemplary surface mount magnetic component 300 according to an exemplary embodiment of the invention. FIG. 7 is an exploded view of the component 300, FIG. 8 is a top perspective assembly view of the component 300, and FIG. 9 is a bottom perspective assembly view of the component 300. The component 300 is similar to the components 100 (FIGS. 1-3) and 200 (FIGS. 4-7) described above in many aspects and like reference characters are utilized in the figures to denote like features in the components 300, 200 and 100.

Comparing FIGS. 1-6 with FIGS. 7-10, it is seen that in the component 300 the depressed surfaces 136 and 138 on the base wall 114 of the first core piece 110 are oriented approximately 90° from their position in the components 100 and 200. That is, in the component 300 the depressed surfaces extend along the side walls 120 and 122 instead of the side walls 116 and 118 as in the components 100 and 200. Also, the depressed surfaces 140, 142 are located on the side walls 120 and 122 rather than on the side walls 116, 118.

Additionally, and as shown in FIG. 7, the external surface of the base wall 114 of the first core piece 110 includes third and fourth depressed surfaces 302 and 304 located proximate each corner 128, 130 of the first core piece 110. The third and fourth depressed surfaces 302 and 304 extend in a generally coplanar relationship to one another and are offset or spaced from the plane of the depressed surfaces 136 and 138. The depressed surfaces 136 and 138 are in turn depressed relative to the remainder of the base wall 114 that does not include a depressed surface. Thus, the base wall 114 in the component 300 is stepped to include three levels of surfaces rather than two as in the components 100 and 200, the three levels being the level of the non-depressed surface separating the first and second depressed surfaces 136 and 138, the first depressed level of the depressed surfaces 136 and 138, and the second level of the depressed surfaces 302 and 304. Through holes 306, 308 are further provided to extend through the third and fourth depressed surfaces 302 and 304.

As also seen in FIG. 7, a coil 320 is provided that unlike the coil 104 of component 100 and 200, is fabricated from a length of rectangular conductor, sometimes referred to as a flat wire, rather than a round wire as in the components 100 and 200. The flat wire includes a first end or lead 322, a second end or lead 324 opposing the first end, and a winding portion 324 between the coil ends 322 and 324 wherein the wire is wound about a coil axis 328 for a number of turns to achieve a desired effect, such as, for example, a desired inductance value for a selected end use application of the component 300. The ends 322, 324 are bent relative to the winding portion 326 so that the ends extend parallel to the coil axis 328 to facilitate termination of the coil ends 322, 324 as explained below.

The terminals clips 106 and 108 each include a coil section 330 extending axially from one end 334 of the bottom section 160 of each clip 106, 108. The coil section 330 extends in a plane generally parallel to but spaced from the plane of the bottom section 160. That is, the clips 106, 108 are shaped to include stepped surfaces 160, 330 that complement the stepped depressed surfaces 136, 138 and 302, 304 of the core piece 110. When the clips 106, 108 are installed to the core piece 100, the bottom section 160 of each clip abuts one of the first and second depressed surfaces 136, 138 with the coil section 330 of each clip 106, 108 abutting one of the third and fourth depressed surfaces 302, 304.

The coil section 330 of each terminal clip 106, 108 may further include a through hole 332 of similar size and shape to the through holes 306 and 308 formed in the first core piece 110 proximate the corners 128, 130 thereof. Each of the through holes 306, 308 and 332 are aligned with another as the terminal clips 106, 108 are assembled to the core piece 110, and the ends 322, 324 of the coil 320 are extended through the aligned through holes 306, 308 and 332. The through holes 306, 308 and 332 are complementary in shape to the flat wire used to fabricate the coil 320 and hence are rectangular. The through holes 306, 308 and 332 ensure a proper position of the position of the coil 320 during assembly of the component 300, and the windows 131, 132 formed in the first core piece 110 allow access to the coil ends 322, 324 to make the electrical connection between the coil ends 322, 324 and the coil sections 322, 324 of the terminal clips 106, 108 via soldering or other techniques.

As shown in FIG. 7, when the component 300 is mounted to the circuit board 180 the base wall 114 of the first core piece 110 faces and abuts the board surface 184 and the flat and planar bottom sections 160 of each terminal clip 106, 108 is electrically connected to the conductive traces 182 on the board 180 via soldering techniques or other techniques known in the art.

Except as noted above, the benefits of the component 300 are otherwise comparable to the components 100 and 200.

Figure 10:
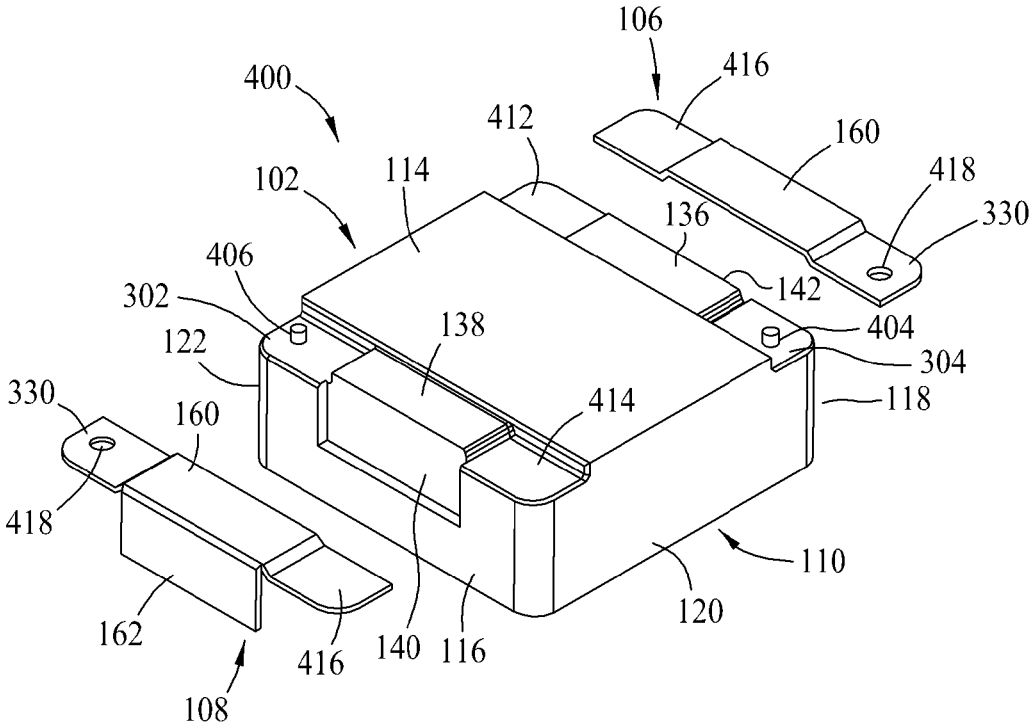
FIG. 10 is a partial exploded view of a fourth exemplary surface mount magnetic component according to an exemplary embodiment of the invention.
Figure 11:
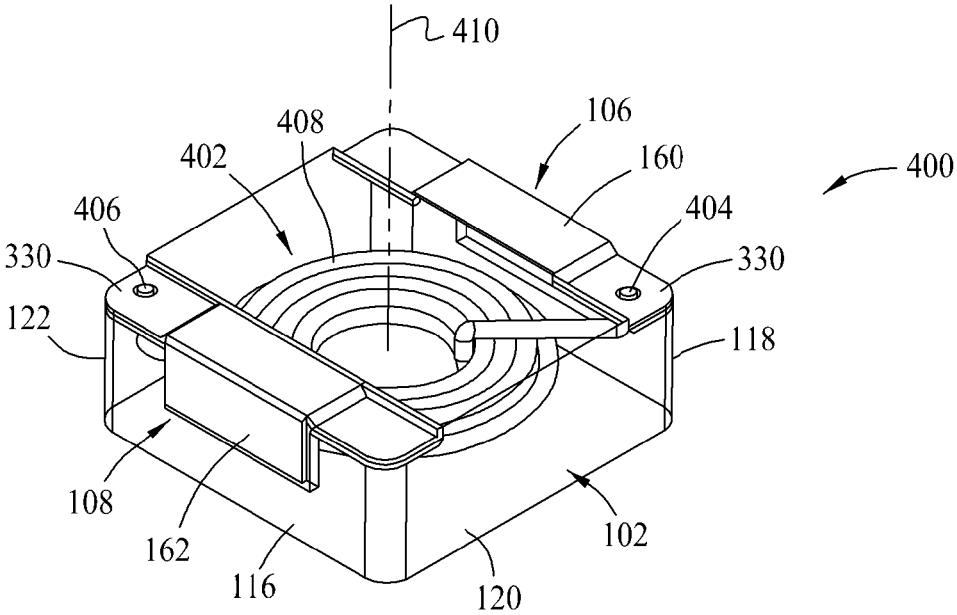
FIG. 11 is a top perspective schematic view of the magnetic component shown in FIG. 10.
Figure 12:
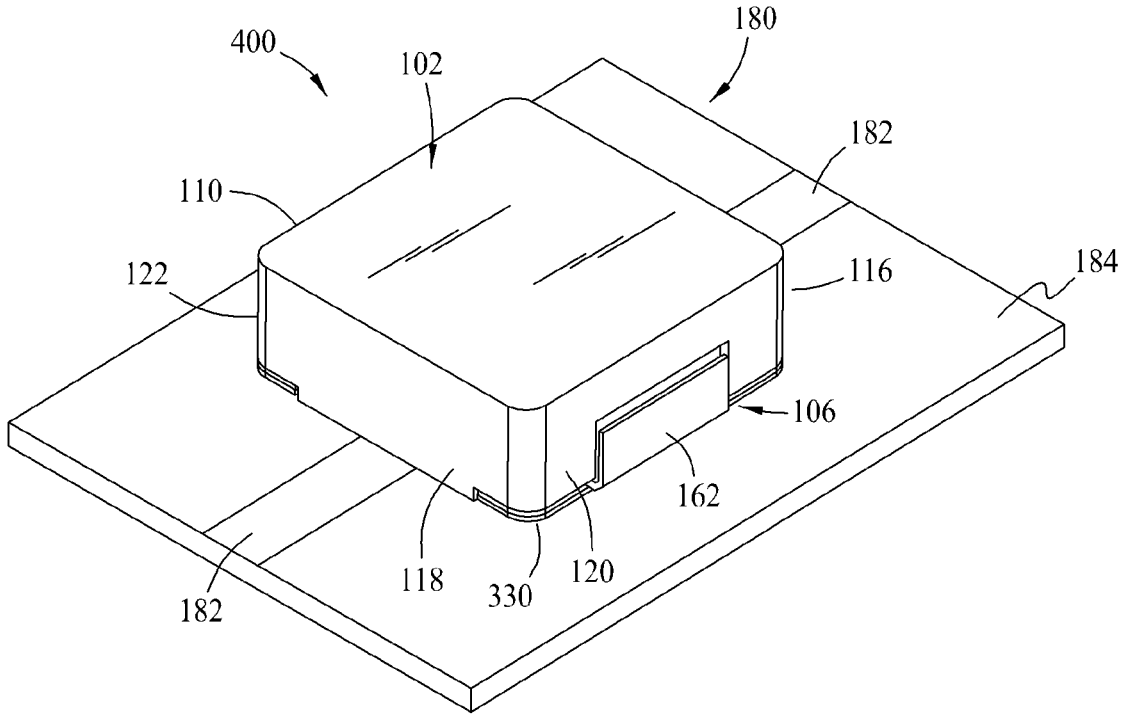
FIG. 12 is a top perspective assembly view of the magnetic component shown in FIG. 10.
Figure 13:
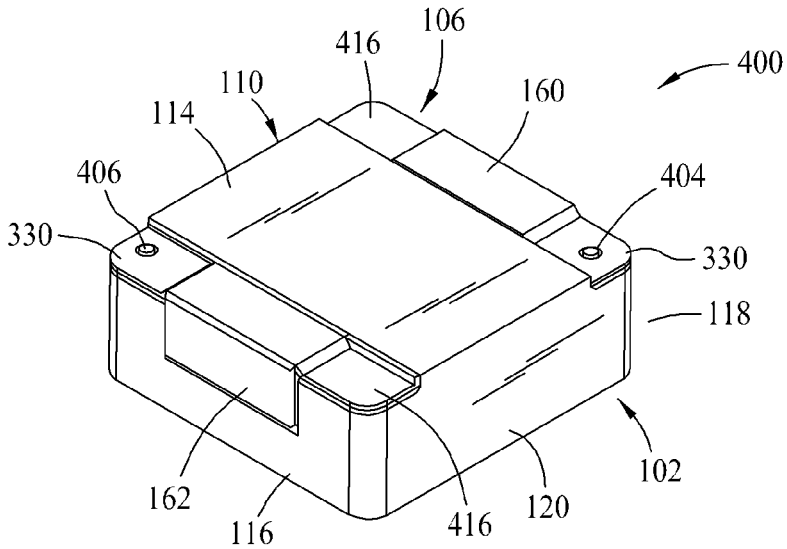
FIG. 13 is a bottom perspective assembly view of the magnetic component shown in FIG. 10.

FIGS. 10-13 are various views of a fourth exemplary surface mount magnetic component 400 according to an exemplary embodiment of the invention. FIG. 10 is a partial exploded view of a the surface mount magnetic component 400, FIG. 11 is a top perspective schematic view of the magnetic component 400, FIG. 12 is a top perspective assembly view of the magnetic component 400, and FIG. 13 is a bottom perspective assembly view of the magnetic component shown in FIG. 10. The component 400 is similar to the components 100 (FIGS. 1-3), 200 (FIGS. 4-6), and 300 (FIGS. 7-9) described above in many aspects and like reference characters are utilized in the figures to denote like features in the components 400, 300, 200 and 100.

Unlike the components 100, 200 and 300 illustrated in FIGS. 1-9, the component 400 includes a core 102 fabricated in a single piece 110 rather than two discrete pieces previously described for the components 100, 200 and 300. In one exemplary embodiment, the core piece 110 for the component 400 may be fabricated from a magnetic powder material familiar to those in the art and pressed or compressed around a coil 402 to form an integral core and coil construction.

The coil 402, best seen in FIG. 11, is fabricated from a length of round wire and includes a first end or lead 404, a second end or lead 406 opposing the first end, and a winding portion 408 between the coil ends 404 and 406 wherein the wire is wound about a coil axis 410 for a number of turns to achieve a desired effect, such as, for example, a desired inductance value for a selected end use application of the component 400. Additionally, and unlike the coil embodiments shown in FIGS. 1-9, the coil is wound in both a helical manner along the axis 410 and spiral form relative to the axis 410 to provide a more compact coil design to meet low profile requirements while still providing a desired inductance value. The ends 404, 406 are bent relative to the winding portion 408 so that the ends extend parallel to the coil axis 410 to facilitate termination of the coil ends 404, 406 as explained below.

The external surface of the base wall 114 of the core piece 110 includes a non-depressed surface separating the first and second depressed surfaces 136 and 138, the third and fourth depressed surfaces 302 and 304 and fifth and sixth depressed surfaces 412, 414. The fifth and sixth depressed surfaces 412, 414 oppose the third and fourth depressed surfaces 302 and 304 on the corners of the core piece 110. In the illustrated embodiment, the fifth and sixth depressed surfaces 412, 414 extend in a generally coplanar relationship to one another, and also in a generally coplanar relationship to the third and fourth depressed surfaces 302, and 304. Thus, the base wall 114 is stepped with three levels of surfaces, with the first level being the non-depressed surface, the second level being the depressed surfaces 136 and 138 spaced from the first level by a first amount, and the third level being the depressed surfaces 302, 304, 412, 414 spaced from each of the first and second levels. The depressed surfaces 136, 304 and 412 are spaced apart and separated from the depressed surfaces 138, 302 and 414 by the non-depressed surface. The depressed surfaces 302 and 414 are spaced apart and separated by the depressed surface 138, and the depressed surfaces 304 and 412 are spaced apart and separated by the depressed surface 136.

The terminal clips 106 and 108 of the component 400 include mounting sections 416 extending opposite the coil sections 330 from the bottom sections 160. In the illustrated embodiment, the mounting sections 416 extend in a generally coplanar relationship to the coil sections 416 and are offset or spaced from the plane of the bottom sections 160. The clips 106, 108 are assembled to the core piece 110 with the flat sections 160 abutting the depressed surfaces 136 and 138, the coil sections 330 abutting the depressed surfaces 302 and 304, and the mounting sections abutting the depressed surfaces 412 and 414. As also shown in FIGS. 10 and 11, the coil ends 404 and 406 are extended through the through holes 418 in the coil sections 330 of the terminal clips 106, 108, where they may be soldered or otherwise attached to ensure electrical connection between the coil ends 404, 406 and the coil 402. Because the coil ends 404, 406 are located on recessed surfaces on the base wall 114 of the core piece 110, however, they do not protrude from the overall exterior surface of the core piece 110 and are less prone to undesirable separation as the component 400 is being handled.

Because the core piece 110 is pressed around the coil 402, the core windows described in relation to the foregoing embodiments are no longer needed, and electrical connections between the coil ends 404, 406 and the terminal clips 106, 108 are moved exterior to the core structure. As shown in FIG. 12, when the component 400 is mounted to the circuit board 180 the base wall 114 of the first core piece 110 faces and abuts the board surface 184 and the flat and planar bottom sections 160 of each terminal clip 106, 108 is electrically connected to the conductive traces 182 on the board 180 via soldering techniques or other techniques known in the art. The coil sections 330 of each clip 106, 108 each face the circuit board 180 and the electrical connections between the coil ends 404, 406 and the coil sections 330 of the clips are substantially protected beneath the core structure.

Except as noted above, the benefits of the component 400 are otherwise comparable to the components 100, 200 and 300.

Figure 14:
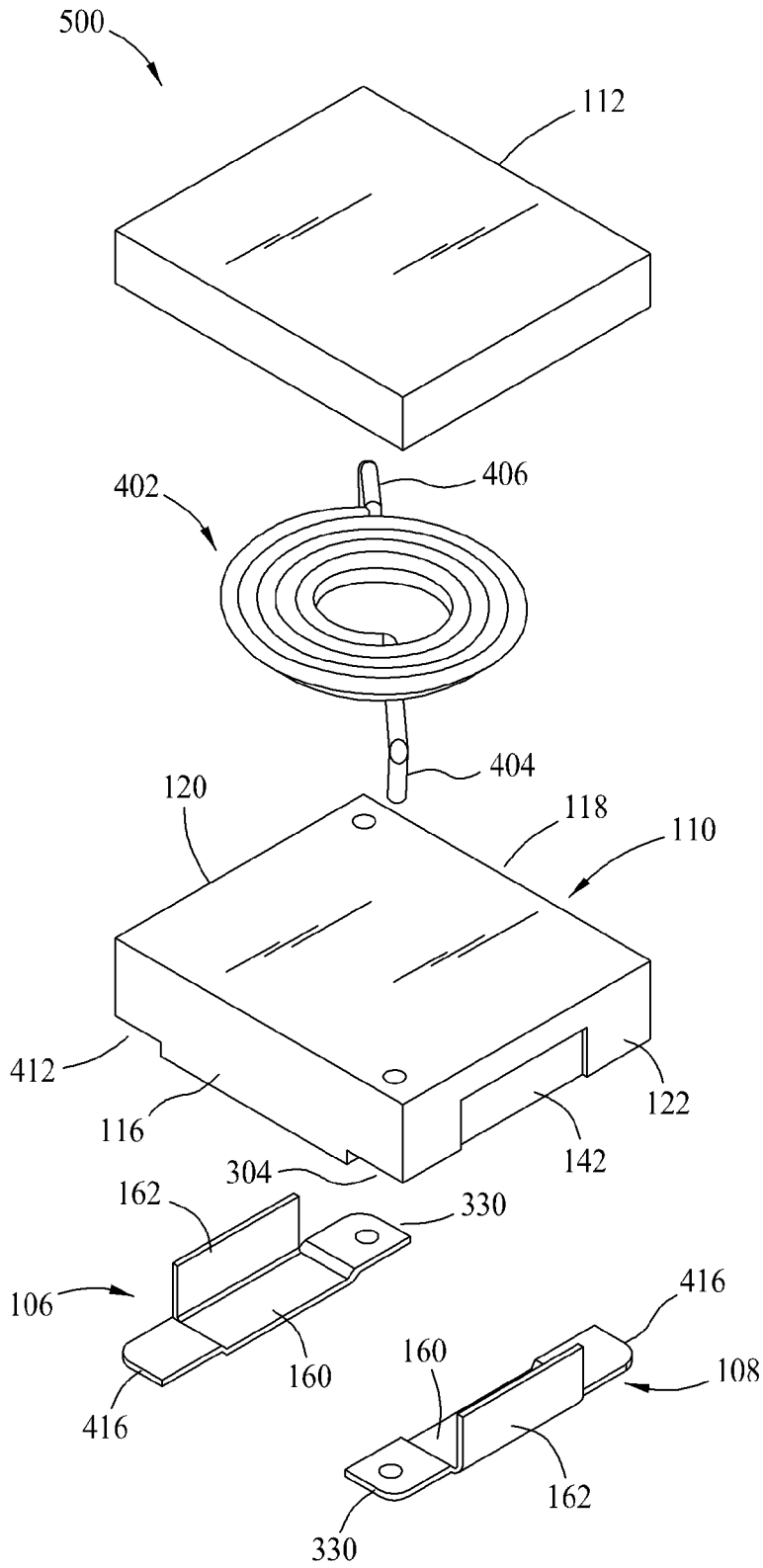
FIG. 14 is a partial exploded view of a fifth exemplary magnetic component according to an exemplary embodiment of the invention.
Figure 15:
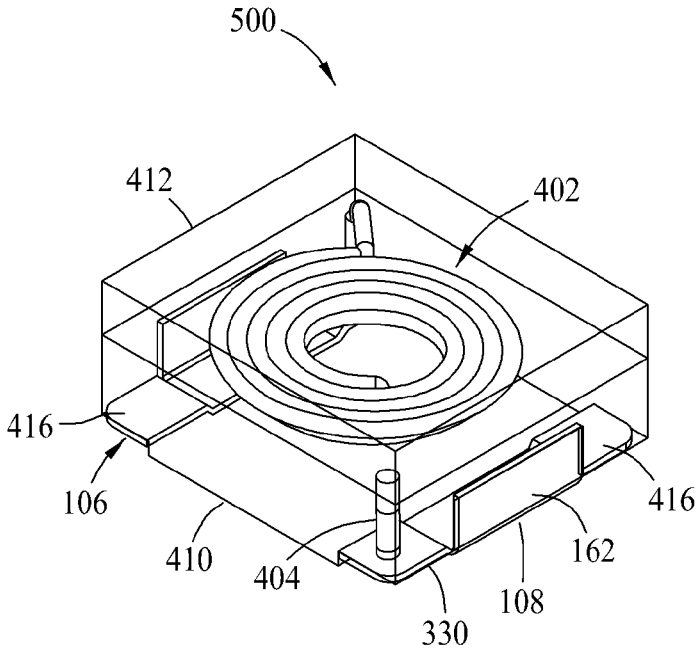
FIG. 15 is a top perspective schematic view of the magnetic component shown in FIG. 14.
Figure 16:
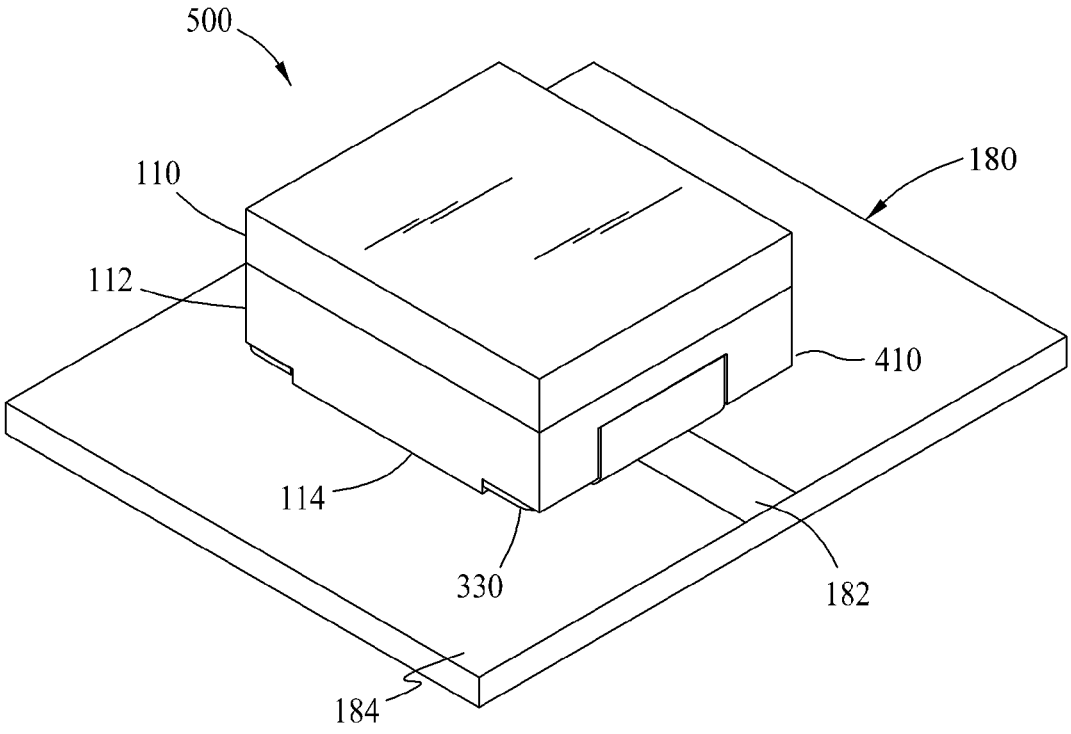
FIG. 16 is a top perspective assembly view of the magnetic component shown in FIG. 14.
Figure 17:
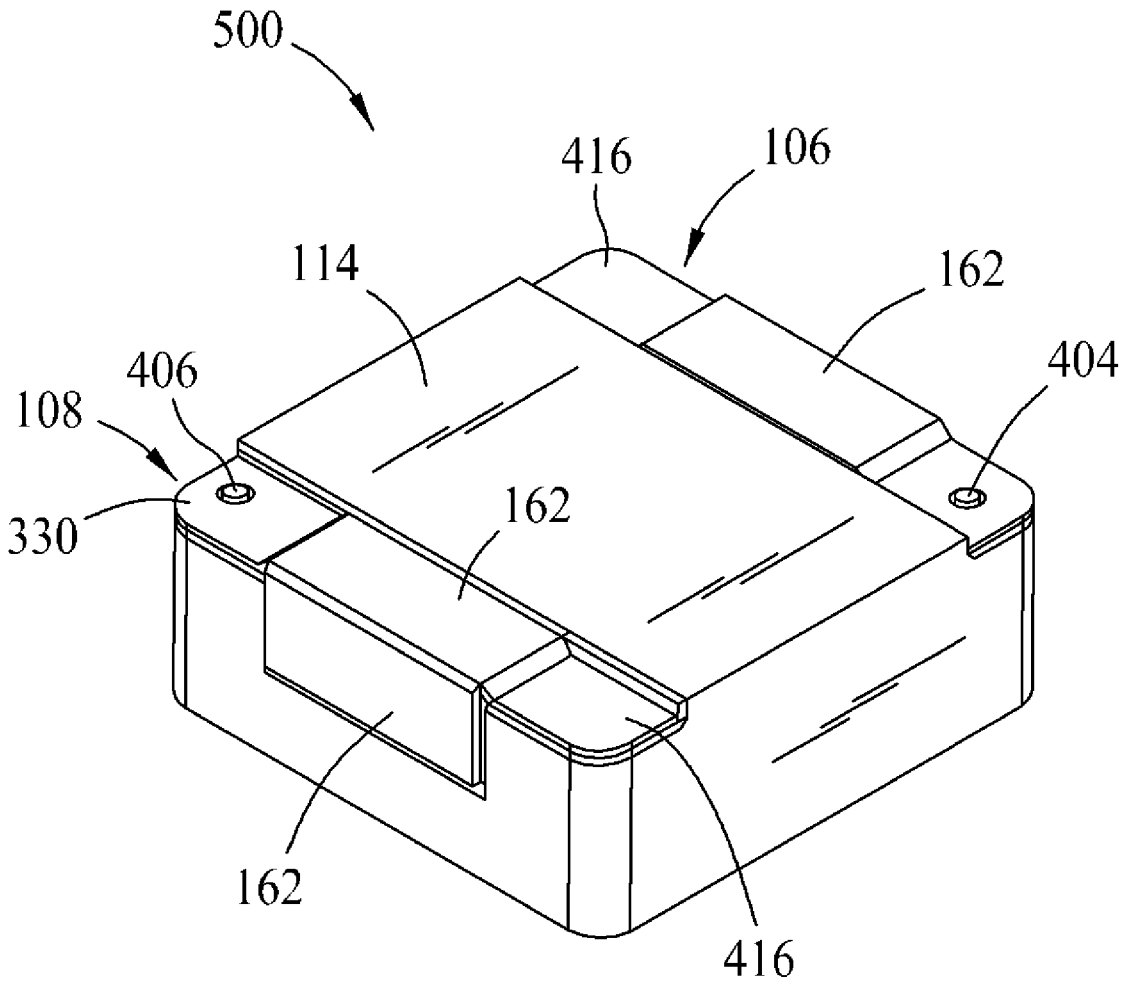
FIG. 17 is a bottom perspective assembly view of the magnetic component shown in FIG. 14.

FIGS. 14-17 are various views of a fifth exemplary surface mount magnetic component 500 according to an exemplary embodiment of the invention. FIG. 14 is a partial exploded view of the component 500, FIG. 15 is a top perspective schematic view of the component 500, and FIG. 16 is a top perspective assembly view of the component 500. FIG. 17 is a bottom perspective assembly view of the magnetic component shown in FIG. 14. The component 500 is similar to the components 100 (FIGS. 1-3), 200 (FIGS. 4-6), 300 (FIGS. 7-9), and 400 (FIGS. 10-13) described above in many aspects and like reference characters are utilized in the figures to denote like features in the components 500, 400, 300, 200 and 100.

The component 500 is similar to the component 400, but includes discrete core pieces 110 and 112, with the second core piece 112 being assembled to the first with the core 402 positioned therebetween. The benefits of the component 500 are otherwise comparable to the benefit of the component 400.

III. Conclusion

It is understood that certain features of the components described above may be mixed and matched to provide still other embodiments of magnetic components with similar advantages. The exemplary embodiments described above are provided for purposes of illustration rather than limitation, and the features of the illustrative embodiments are neither intended to be exclusive to only those embodiments, nor to preclude the presence of additional or different features in each embodiment. As one example, more than one of the core shapes and/or terminal clip configurations could be utilized in combination in the same device, such as an embodiment having more than one coil wherein different terminal clip configurations are utilized to terminate each coil. As another example, other shapes and configurations of coils beyond those described and illustrated are known and could be used with terminal clips such as those described with similar effect.

The benefits and advantages of the inventive concepts are now believed to be evident. A variety of embodiments of magnetic components have now been described in detail that, among other things, allow more compact and consistent component size and shapes with optimal power and energy densities for modern electronic devices. Smaller footprints for surface mount magnetic components are possible with simplified manufacturing processes having fewer steps. Consistent and reliable electrical connection between the coil leads and terminal clips may be more easily accomplished using relatively low cost manufacturing techniques. More consistent electrical and mechanical characteristics of the components may be realized.

The unique core shapes and terminal clips as described facilitate a better form factor and more consistent, compact and robust designs for high current power inductors relative to existing designs.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A surface mount magnetic component assembly comprising:

a magnetic core defining an external wall having a first substantially planar exterior surface for mounting to a circuit board, the external wall further having a second substantially planar exterior surface adjacent the first substantially planar exterior surface, the second substantially planar exterior surface being depressed relative to the first substantially exterior surface;

wherein the second substantially planar surface is provided with a through hole;

a conductive coil, the coil including first and second ends; and at least one of the first and second ends extending through the through hole in a direction substantially perpendicular to the first substantially planar exterior surface.

2. The magnetic component assembly of claim 1, wherein the second substantially planar exterior surface extends generally parallel to the first substantially planar exterior surface.

3. The magnetic component assembly of claim 2, wherein the external wall has a first end and a second end opposing the first end, and the second substantially planar exterior surface extends from the first end to the second end.

4. The magnetic component assembly of claim 2, wherein the external wall further comprises a third substantially planar exterior surface extending opposite the second substantially planar exterior surface with the first substantially planar exterior surface separating the second substantially planar exterior surface and the third substantially planar exterior surface.

5. The magnetic component assembly of claim 4, wherein the second and third substantially planar exterior surfaces are substantially coplanar.

6. The magnetic component assembly of claim 1, the external wall having a corner, and the through-hole extending proximate the corner.

7. A surface mount magnetic component assembly comprising:

a magnetic core defining at least one external side having a stepped surface; and a conductive coil internal to the magnetic core, the coil including first and second ends; and at least one of the first and second ends extending through the at least one side;

wherein the stepped surface comprises a first surface, a second surface and a third surface, wherein the second surface is depressed relative to the first surface and wherein the third surface is depressed relative to the second surface.

8. The magnetic component assembly of claim 7, wherein the at least one side has a first corner and a second corner, the third surface located proximate the first corner and the second surface extending from the third surface to the second corner.

9. The magnetic component assembly of claim 8, wherein the at least one side has a third corner diagonally opposed to the first corner, the at least one side comprising a fourth surface extending generally coplanar to the third surface, the fourth surface located proximate the third corner.

10. The magnetic component of assembly claim 7, wherein the stepped surface further comprises a fourth surface extending generally coplanar to the third surface, the third and fourth surface being separated by the first surface.

11. The magnetic component assembly of claim 1, wherein the magnetic core comprises a first core piece and a second core piece, one of the first and second core piece defining the external wall.

12. The magnetic component assembly of claim 11, wherein the external wall is defined by the first core piece, wherein the external wall comprises a base wall, and upstanding side walls extend from the base wall.

13. The magnetic component assembly of claim 12, wherein the second core piece is substantially planar.

14. The magnetic component assembly of claim 1, wherein the external wall comprises a base wall, and wherein the magnetic core further comprises a first side wall extending from the base wall, and a second side wall extending from the base wall; and wherein the first and second side walls are gapped to provide a window in the core.

15. The magnetic component assembly of claim 14, wherein the window is located proximate a corner of the base wall.

16. The magnetic component assembly of claim 1, further comprising at least one terminal clip configured for attachment to the second substantially planar exterior surface of the core.

17. A surface mount magnetic component assembly comprising:

a magnetic core defining at least one external side having a stepped surface; and a conductive coil internal to the magnetic core, the coil including first and second ends; and at least one of the first and second ends extending through the at least one side;

at least one terminal clip configured for attachment to the stepped surface of the core;

wherein the at least one terminal clip includes a bottom section extending in a first plane and a coil section extending in a second plane, the first and second plane being parallel to but spaced from one another.

18. The magnetic component assembly of claim 17, wherein the coil section extends internal to the core.

19. The magnetic component assembly of claim 18, wherein the at least one terminal clip defines a slot and a portion of the core being received in the slot between the bottom section and the coil section.

20. The magnetic component assembly of claim 17, wherein the at least one terminal clip comprises first and second terminal clips, the first and second clips being reversed 180° relative to one another when attached to the core and coil.

21. The magnetic component assembly of claim 17, wherein the at least one terminal clip comprises a third section generally coplanar to the coil section but separated from the terminal section by the bottom section.

22. The magnetic component assembly of claim 16, wherein the terminal clip defines a through hole, and one of the first and second ends of the coil is received in the through hole of the terminal clip.

23. The magnetic component assembly of claim 16, wherein the magnetic core further comprises a second wall adjoining the second substantially planar exterior surface, the second side wall including a recess adjacent the second substantially planar exterior surface, and the at least one terminal clip including a locating tab engaged in the recess.

24. The magnetic component assembly of claim 16, wherein the at least one terminal clip comprises a first terminal clip and a second terminal clip, and wherein the first and second ends of the coil attach to the first and second terminal clips, respectively, without wrapping the first and second ends of the coil around the clips.

25. The magnetic component assembly of claim 1, wherein the coil includes a winding portion between the first and second ends, the winding portion comprising a plurality of turns about a winding axis, and the first and second ends extending generally parallel to the winding axis.

26. The magnetic component assembly of claim 25, wherein the coil comprises one of a flat wire and a round wire wound for a number of turns.

27. The magnetic component assembly of claim 25, wherein the winding extends helically and spirally about the coil axis.

28. The magnetic component assembly of claim 1, further comprising a circuit board, wherein the first substantially planar surface rests upon the circuit board.

29. The magnetic component of claim 28, further comprising first and second terminal clips, the first and second terminal clips connected to a circuit path on the surface of the board and also respectively connected to the first and second ends of the coil.

30. The magnetic component of claim 29, the first and second terminals each including a planar bottom section connecting to the circuit path, and a coil section extending in a plane parallel to, but spaced from the planar bottom section.

31. The magnetic component of claim 1, wherein the component is an inductor.

32. A surface mount magnetic component assembly comprising:

a magnetic core having a bottom side defined by first, second, third and fourth corners and having a stepped surface extending between the first, second, third and fourth corners;

a conductive coil internal to the magnetic core, the coil including first and second ends, at least one of the first and second ends extending through the bottom side and a portion of the stepped surface; and first and second terminal clips coupled to the stepped surface and respectively connecting to the first and second ends of the coil.

33. The magnetic component assembly of claim 32, wherein the core defines at least one window proximate one of the first, second, third and fourth corners for connecting one of the first and second coil leads to the one of the first and second terminal clips at a location interior to the core.

34. A surface mount magnetic component assembly comprising:

a magnetic core defining at least one external side with first, second, third and fourth corners and having a stepped surface;

a conductive coil internal to the magnetic core, the coil including first and second ends, at least one of the first and second ends extending through the at least one external side; and first and second terminal clips coupled to the stepped surface and respectively connecting to the first and second ends of the coil;

wherein each of the first and second terminal clips includes a bottom section extending in a first plane and a coil section extending in a second plane, the second plane being parallel to but spaced from the first plane.

35. The magnetic component assembly of claim 34, wherein the first and third corners are diagonally opposite one another, and the coil sections of each of the first and second terminal clip are proximate the first and third corners.

36. The magnetic component assembly of claim 32, wherein the coil comprises one of a flat wire and around wire wound about an axis for a number of turns.

37. The magnetic component assembly of claim 32, further comprising a circuit board, the bottom side being surface mounted to the circuit board.

38. The magnetic component of claim 32, wherein at least one of the first and second terminal clips is bilaterally asymmetrical.

39. The magnetic component assembly of claim 32, wherein the component is an inductor.

* * * * *

UNITED STATES PATENT AND TRADEMARK OFFICE

CERTIFICATE OF CORRECTION

PATENT NO. : 7,986,208 B2
APPLICATION NO. : 12/429856
DATED : July 26, 2011
INVENTOR(S) : Yipeng Yan et al.

It is certified that error appears in the above-identified patent and that said Letters Patent is hereby corrected as shown below:

In the Claims

In Column 17, Line 60, in Claim 21, delete "terminal" and insert therefor -- coil --.

In Column 18, Line 21, in Claim 27, delete "coil" and insert therefor -- winding --.

Signed and Sealed this
Thirteenth Day of May, 2014

Michelle K. Lee

Michelle K. Lee
*Deputy Director of the United States Patent and Trademark Office*